US010132210B1

(12) United States Patent
Mossberg et al.

(10) Patent No.: US 10,132,210 B1
(45) Date of Patent: Nov. 20, 2018

(54) ELECTRIC CAMSHAFT PHASER WITH DETENT AND METHOD THEREOF

(71) Applicant: Schaeffler Technologies AG & Co. KG, Herzogenaurach (DE)

(72) Inventors: Jeffrey Mossberg, Troy, MI (US); Andrew Mlinaric, Tecumseh (CA); Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 73 days.

(21) Appl. No.: 15/595,984

(22) Filed: May 16, 2017

(51) Int. Cl.

| | |
|---|---|
| ***F01L 1/34*** | (2006.01) |
| ***F01L 1/344*** | (2006.01) |
| ***F01L 1/352*** | (2006.01) |
| *F01L 9/04* | (2006.01) |

(52) U.S. Cl.
CPC ..... *F01L 1/34409* (2013.01); *F01L 1/352* (2013.01); *F01L 9/04* (2013.01)

(58) Field of Classification Search
CPC ..... F01L 1/352; F01L 1/34409; F01L 9/04
USPC ..... 123/90.15, 90.17
See application file for complete search history.

(56) References Cited

U.S. PATENT DOCUMENTS

| | | | | |
|---|---|---|---|---|
| 6,032,626 | A | 3/2000 | Haag | |
| 7,377,245 | B2 | 5/2008 | Morii et al. | |
| 7,503,294 | B2 * | 3/2009 | Ogawa | F01L 1/3442 123/90.16 |
| 8,677,961 | B2 | 3/2014 | Fischer | |
| 2001/0022165 | A1 | 9/2001 | Golovatai-Schmidt | |
| 2016/0245131 | A1 | 8/2016 | Chung | |

FOREIGN PATENT DOCUMENTS

| | | | |
|---|---|---|---|
| EP | 1813783 | A1 | 8/2007 |
| JP | 2014-240639 | A | 12/2014 |
| WO | 2015-200190 | A1 | 12/2015 |

* cited by examiner

*Primary Examiner* — Ching Chang

(57) ABSTRACT

A camshaft phaser, including: a stator to receive rotational torque from an engine and including a radially inwardly facing surface and a slot in the radially inwardly facing surface; a rotor to non-rotatably connect to a camshaft, to be connected to an electric motor and including a first radially outwardly extending protrusion; and a spring non-rotatably connected to the stator and including a first portion disposed in the slot. The electric motor is arranged to rotate the rotor with respect to the stator. In a first circumferential position of the rotor with respect to the stator: no portion of the spring is disposed in the indent; and a second portion of the spring extends radially inwardly past the radially inwardly facing surface. In a second circumferential position of the rotor with respect to the stator, the second portion of the spring is disposed in the indent.

20 Claims, 12 Drawing Sheets

ELECTRIC CAMSHAFT PHASER WITH DETENT AND METHOD THEREOF

TECHNICAL FIELD

The present disclosure relates to an electric camshaft phaser with a spring and detent to lock the rotor into a pre-determined position upon shut down of an engine.

BACKGROUND

A known problem for electric camshaft phasers is "drift" of the rotor relative to the stator after engine shut-down. For example, immediately or shortly after engine shutdown, torque may be transmitted to the rotor in sufficient magnitude to cause the electric camshaft phaser to drift, or shift away from an intended control angle of the rotor with respect to the stator due to a lack of inherent resisting torque in the electric camshaft phaser or inherent friction associated with the electric motor and gearbox combination in the electric camshaft phaser. The rotational direction and magnitude of the residual torque and inherent friction are unpredictable; therefore, the rotation and eventual final control angle of the rotor due to the residual torque from the camshaft or the inherent friction cannot be predicted.

FIG. 12 is prior art taken from FIG. 13 of PCT Patent Application PCT/US2015/036928 (the '928 application). Electric camshaft phaser 38 includes portion 46 in rotational communication with a crankshaft, portion 48 attached to a camshaft and in rotational communication with portion 46, and portion 50 operatively attached to an actuator and in rotational communication with portion 48. Phaser 38 also includes locks 54 (in the form of lever springs) with ends 92 connected to portion 50, and ends 94 with portions 98 for releasably engaging receivers 52 in portion 48. Locks 54 can be used to lock portion 50 to portion 48. During operation of phaser 38 with portions 98 not engaged with receivers 54, portions 98 are in constant contact with portion 48 resulting in drag on the operation of the actuator and constant flexing of the lever springs, which reduces service life of the lever springs.

SUMMARY

According to aspects illustrated herein, there is provided a camshaft phaser, including: a stator arranged to receive rotational torque from an engine and including a radially inwardly facing surface; a rotor arranged to non-rotatably connect to a camshaft, arranged to be connected to an electric motor and including a first radially outwardly extending protrusion, the first radially outwardly extending protrusion including a radially outer surface; an axis of rotation for the stator and rotor; and a spring. The electric motor is arranged to rotate the rotor with respect to the stator. The radially outer surface includes an indent, the spring is non-rotatably connected to the stator, in a first circumferential position of the rotor with respect to the stator, no portion of the spring is disposed in the indent, and in a second circumferential position of the rotor with respect to the stator, a first portion of the spring is disposed in the indent; or the radially inwardly facing surface includes an indent, the spring is non-rotatably connected to the rotor, in a first circumferential position of the rotor with respect to the stator, no portion of the spring is disposed in the indent, and in a second circumferential position of the rotor with respect to the stator, a first portion of the spring is disposed in the indent.

According to aspects illustrated herein, there is provided a camshaft phaser, including: a stator arranged to receive rotational torque from an engine and including a radially inwardly facing surface and a slot in the radially inwardly facing surface; a rotor arranged to non-rotatably connect to a camshaft, arranged to be connected to an electric motor and including a first radially outwardly extending protrusion with a radially outward surface with a radially inwardly extending slot; an axis of rotation for the stator and rotor; and a spring non-rotatably connected to the stator and including a first portion disposed in the slot. The electric motor is arranged to rotate the rotor with respect to the stator. In a first circumferential position of the rotor with respect to the stator: no portion of the spring is disposed in the indent; and a second portion of the spring extends radially inwardly past the radially inwardly facing surface. In a second circumferential position of the rotor with respect to the stator, the second portion of the spring is disposed in the indent.

According to aspects illustrated herein, there is provided a camshaft phaser, including: a stator arranged to receive rotational torque from an engine and including a radially inwardly facing surface with an indent; a rotor arranged to non-rotatably connect to a camshaft, arranged to be connected to an electric motor and including a first radially outwardly extending protrusion, the first radially outwardly extending protrusion including a radially outer surface and a slot in the radially outer surface; an axis of rotation for the stator and rotor; and a spring non-rotatably connected to the rotor and including a first portion disposed in the slot. The electric motor is arranged to rotate the rotor with respect to the stator. In a first circumferential position of the rotor with respect to the stator: no portion of the spring is disposed in the indent; and a second portion of the spring extends radially outwardly past the radially outer surface. In a second circumferential position of the rotor with respect to the stator, the second portion of the spring is disposed in the indent.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 11:
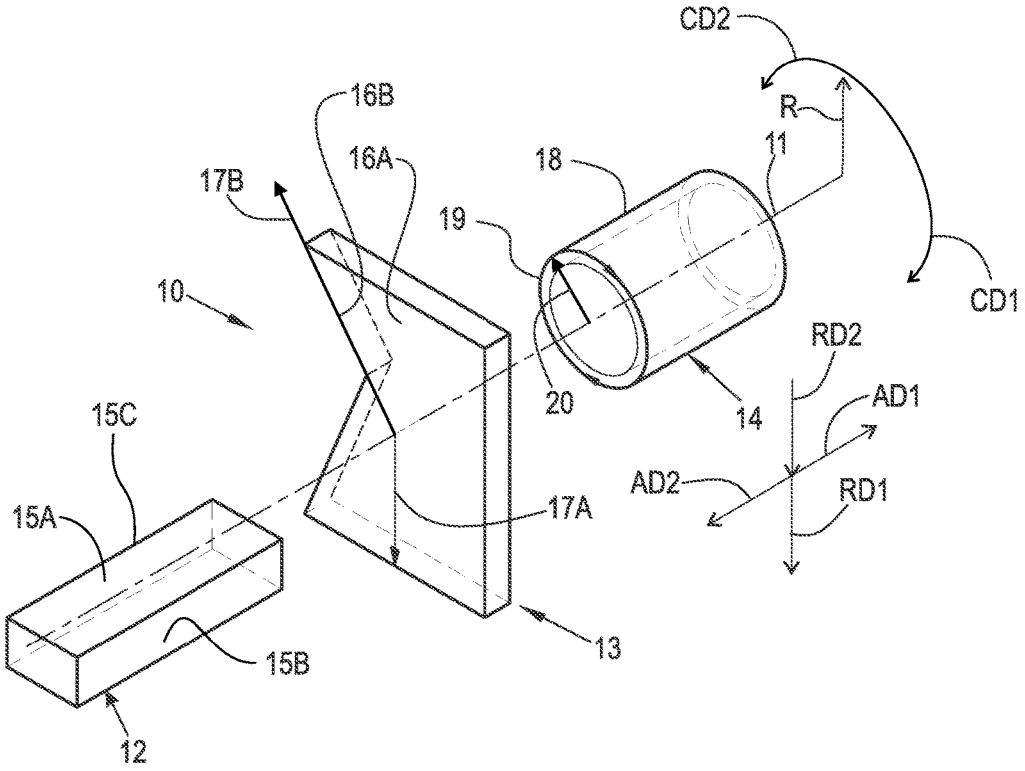
FIG. 11 is a perspective view of a cylindrical coordinate system demonstrating spatial terminology used in the present application; and, FIG. 12 is a prior art drawing taken from FIG. 13 of PCT Patent Application PCT/US2015/036928.
Figure 12:
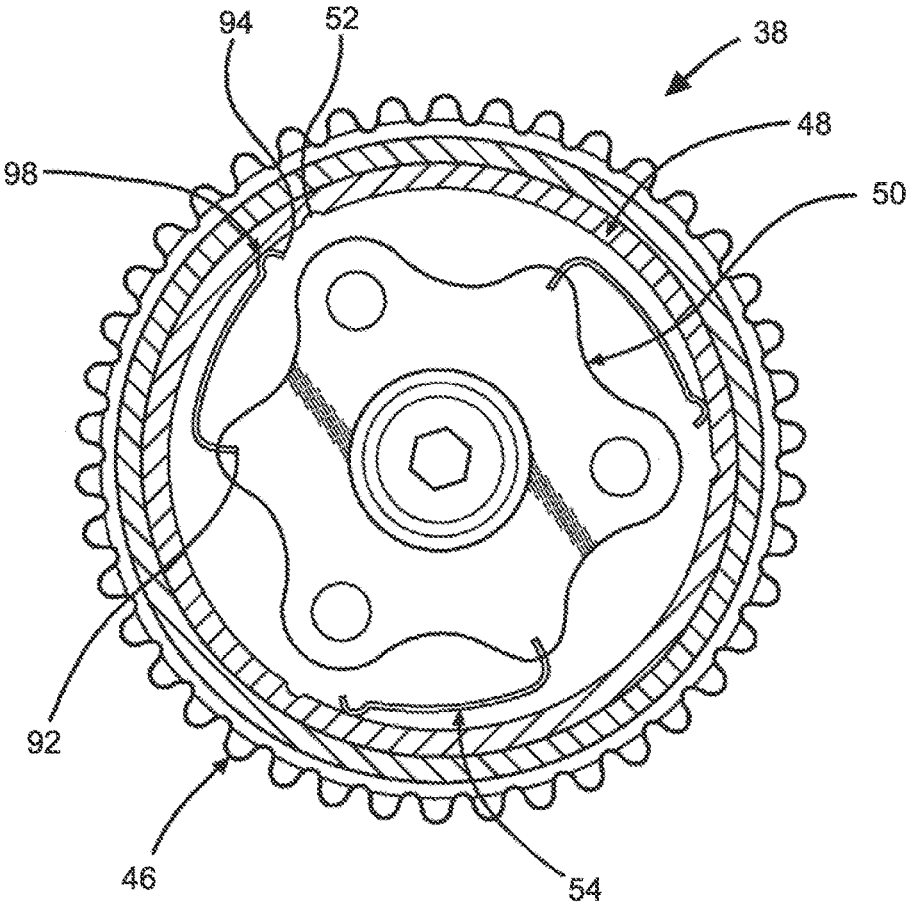
PRIOR ART Fig. 12

FIG. 11 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 30, passes through surface 18.

Axial movement is in direction axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
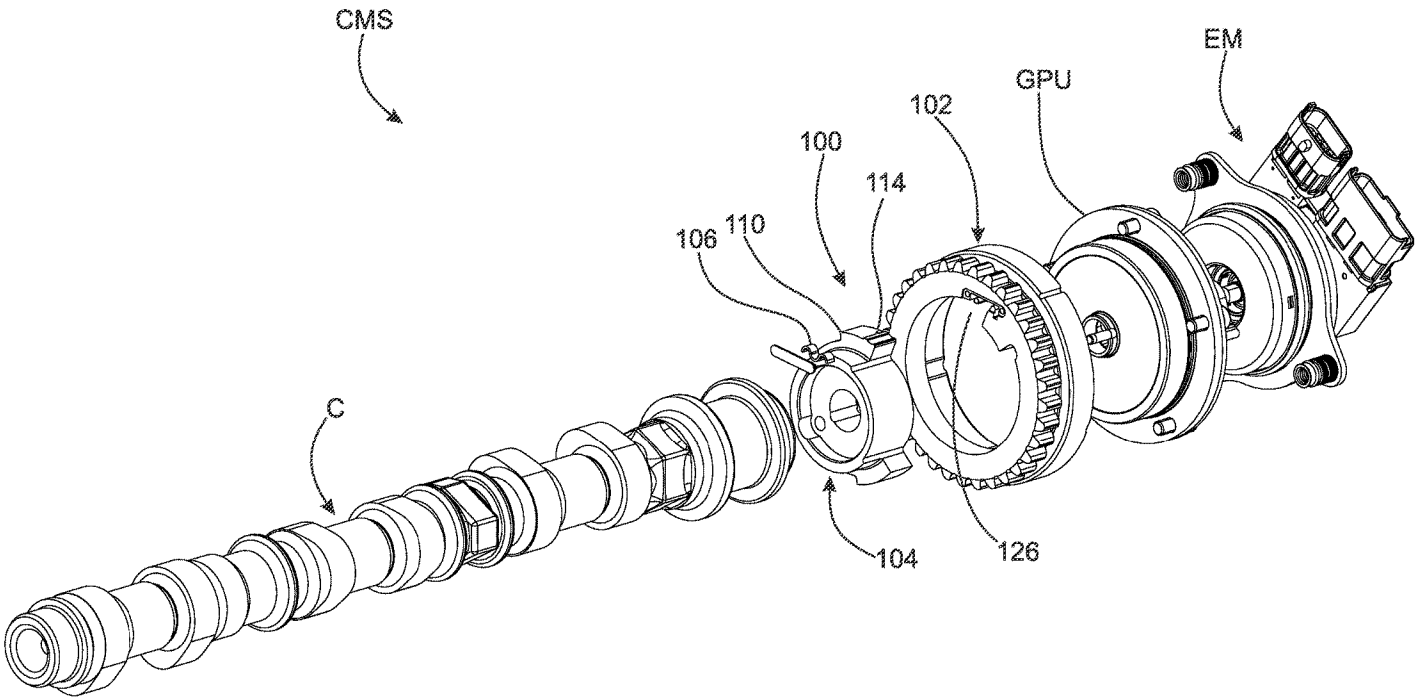
FIG. 1 is an exploded view of a camshaft system including a camshaft phaser with rotor locking.

FIG. 1 is an exploded view of camshaft system CMS including camshaft phaser 100 with rotor locking.

Figure 2:
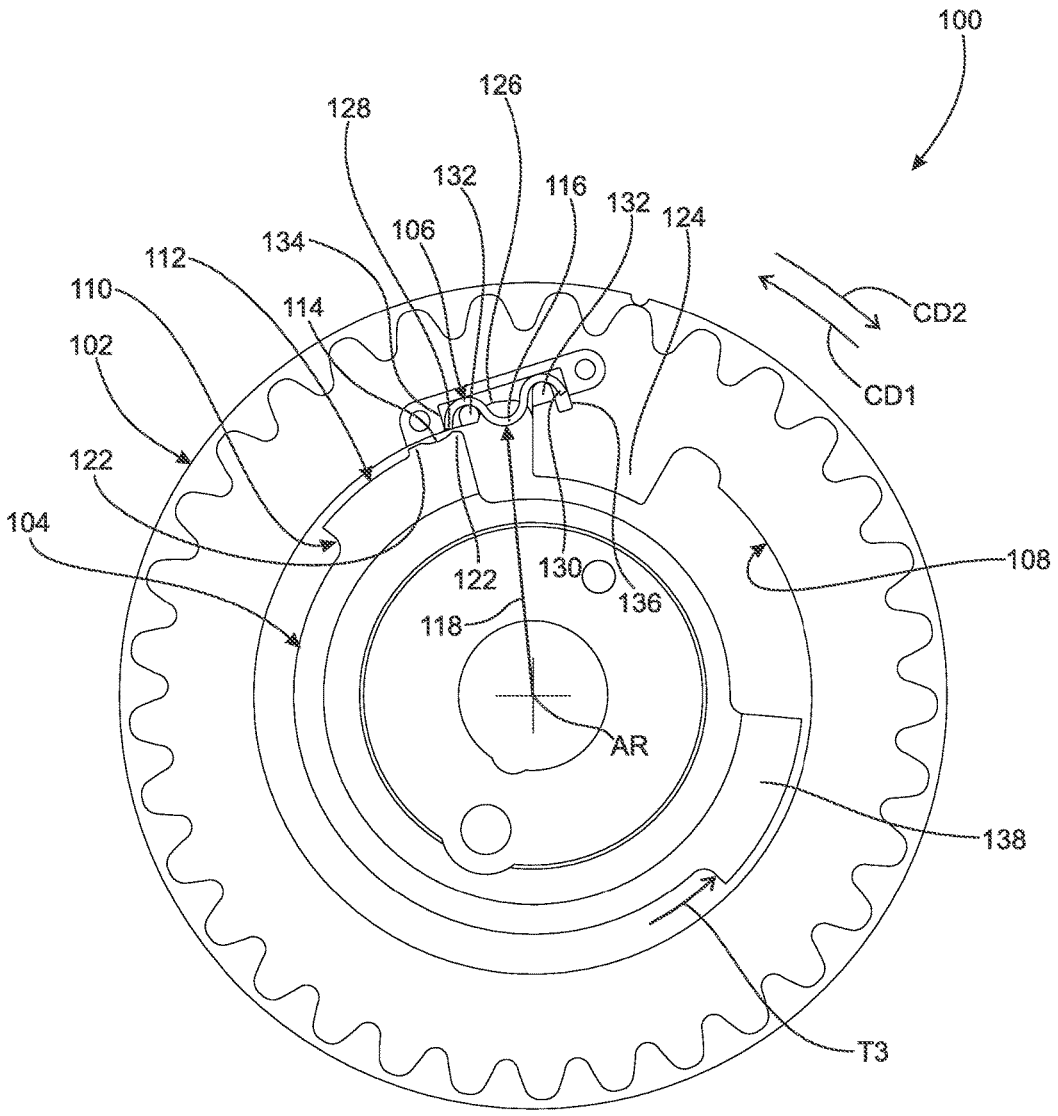
FIG. 2 is a cut-away view of the camshaft phaser of FIG. 1 with a rotor in a first circumferential position associated with an operating mode for the camshaft phaser.

FIG. 2 is a cut-away view of camshaft phaser 100 of FIG. 1 with a rotor in a first circumferential position associated with an operating mode for phaser 100.

Figure 3:
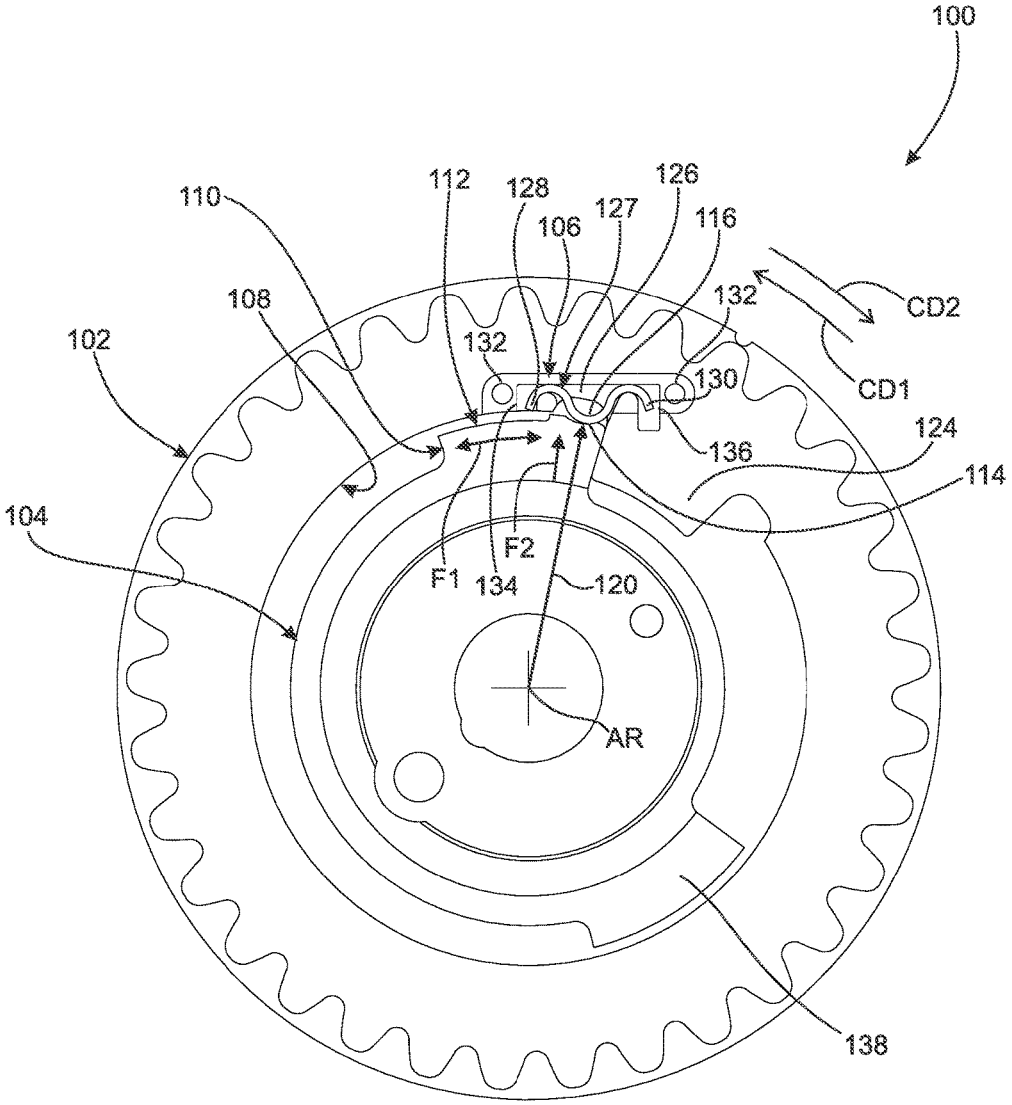
FIG. 3 is a cut-away view of the camshaft phaser of FIG. 1 with the rotor in a second circumferential position associated with a locked mode for the camshaft phaser.

FIG. 3 is a cut-away view of camshaft phaser 100 of FIG. 1 with the rotor in a second circumferential position associated with a locked mode for phaser 100.

Figure 4:
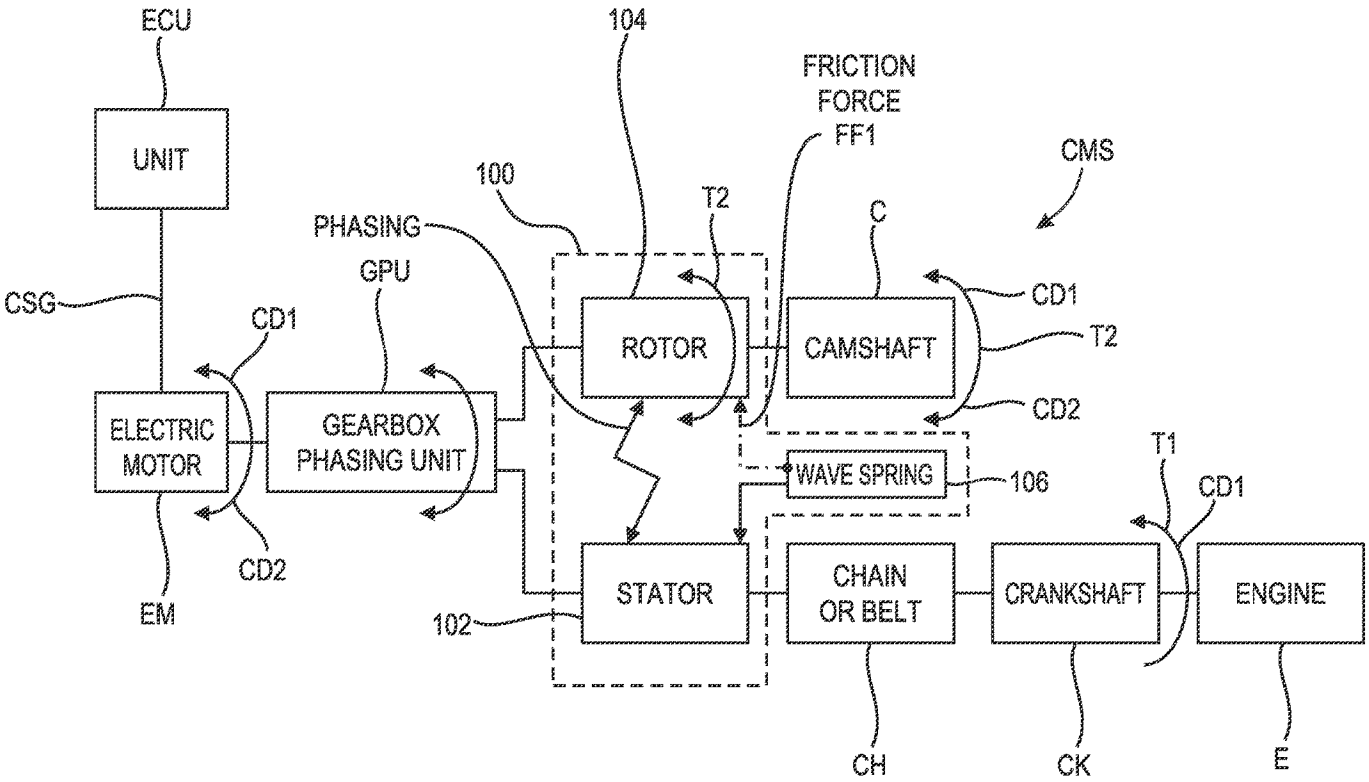
FIG. 4 is a block diagram including the camshaft phaser of FIG. 1.

FIG. 4 is a block diagram including camshaft phaser 100. The following should be viewed in light of FIGS. 1 through 4. Camshaft phaser 100 includes stator 102, rotor 104, axis of rotation AR for stator 102 and rotor 104, and wave spring 106 non-rotatably connected to stator 102. Stator 102 is arranged to receive rotational torque T1 in circumferential direction CD1 from engine E, via crankshaft CK and chain or belt CH, and includes radially inwardly facing surface 108. Rotor 104: is arranged to non-rotatably connect to camshaft C; is arranged to be connected to electric motor EM; and includes radially outwardly extending protrusion, or vane, 110. Protrusion 110 includes radially outer surface 112 with radially inwardly extending indent 114.

By "non-rotatably connected" elements, we mean that: the elements are connected so that whenever one of the elements rotates, all the elements rotate; and relative rotation between the elements is not possible. Radial and/or axial movement of non-rotatably connected elements with respect to each other is possible, but not required.

As is known in the art, in the operating mode in which engine E is running and torque T1 is being transmitted to stator 102 in direction CD1: motor EM rotates rotor 104 and camshaft C in direction CD1 and motor EM simultaneously rotates rotor 104, with respect to stator 102, in opposite circumferential directions CD1 and CD2 as needed, using gearbox phasing unit GPU to set a control angle for rotor 104 and control phasing of camshaft C with respect to stator 102. Unit GPU can be any gearbox phasing unit known in the art, including but not limited to a planetary gear unit, an elliptical gear unit, and a harmonic drive unit.

In the example first circumferential position of rotor 104 with respect to stator 102 shown in FIG. 2 (operating mode), no portion of spring 106 is disposed in indent 114. In the second circumferential position of rotor 104 with respect to stator 102 shown in FIG. 3 (locked mode), portion 116 of spring 106 is disposed in indent 114. As further described below, the engagement of spring 106, in particular portion 116, with indent 114 maintains rotor 104 in the second circumferential position after engine E is de-energized. It should be understood that the exact circumferential position of rotor 104 in FIG. 2 is an example of the plurality of specific circumferential positions possible during the operating mode when portion 116 is not engaged with indent 114. Stated otherwise, any position of rotor 104 in which spring 106 is not in contact with radially outer surface 112 is considered the first circumferential position.

As discussed above, a problem for a known camshaft phaser is "drift" of a rotor for the phaser at engine shutdown. For example, camshaft C applies torque T2 to rotor 104 upon shut-down of engine E. Note that torque T2 is shown in opposite circumferential directions CD1 and CD2, since torque T2 may oscillate between directions CD1 and CD2 after shutdown of engine E. As further described below, the engagement of spring 106 with indent 114 provides a means of providing a known position and control angle of rotor 104 upon engine start up.

For example, upon shut-down of engine E, control signal CSG is sent from electronic control unit ECU to motor EM. In response to signal CSG, motor EM rotates rotor 104, in the example of FIGS. 2 and 3, in circumferential direction CD2, until portion 116 engages indent 114. Spring 106 applies frictional force FF1 to rotor 104. Force FF1 resists rotation of rotor 104 with force F1 greater than torque T2. Thus forces F1 and FF1 prevent torque T2 from rotating rotor 104, and rotor 104 remains in the known position and control angle of FIG. 3 for engine start up.

Upon engine start-up, motor EM rotates, in the example of FIGS. 2 and 3, rotor 104 in direction CD1 with torque T3 to overcome force F1. That is, torque T3 is greater than force F1. Thus, rotor 104 disengages from spring 106 for normal operation of phaser 100 (engine E is activated and phaser 100 is controlling camshaft C).

In an example embodiment of the second circumferential position of FIG. 3, protrusion 110 displaces portion 116 radially outwardly. Thus, in the first circumferential position of FIG. 2, portion 116 is at radial distance 118 from axis AR and in the second circumferential position, portion 116 is at radial distance 120, greater than distance 118, from axis AR.

In the example of FIGS. 2 and 3, spring 106 does not contact surface 112 once rotor 104 rotates out of the second circumferential position of FIG. 3 and into the first circumferential position of FIG. 2, and phaser 100 is in the normal operating mode. Thus, there is no drag on rotor 104 from spring 106 in the operating mode.

Stator 102 includes radially inwardly extending end stop 124. In the example of FIG. 3, protrusion 110 is in contact with stop 124. However, it should be understood that it is not necessary for protrusion 110 to be in contact with stop 124 in the second circumferential position (operating mode).

In the example of FIGS. 2 and 3: stator 102 includes slot 126, a least a portion of which is in surface 108; spring 106 includes portion 127, located in slot 126, with ends 128 and 130, disposed within slot 126; and portion 116 of spring 106 extends radially inwardly past surface 108. In an example embodiment, stator 102 includes posts 132 engaged with spring 106 and retaining spring 106 in slot 126. In an example embodiment: ends 128 and 130 are in contact with walls 134 and 136, respectively, of slot 126 in the first circumferential position; and ends 128 and 130 are not in contact with walls 134 and 136, respectively, of slot 126 in the second circumferential position. For example, force F2, applied by protrusion 110 on spring 106 in the second circumferential position, causes spring 106 to flex so that ends 128 and 130 separate from walls 134 and 136, respectively, of slot 126.

In an example embodiment: end stop 124 is the only radially inwardly projecting end stop for stator 102; rotor 104 includes radially outwardly extending protrusion 138; protrusions 110 and 138 are the only radially outwardly extending protrusions for rotor 104; and end stop 124 is circumferentially disposed between protrusions 110 and 138.

Figure 5:
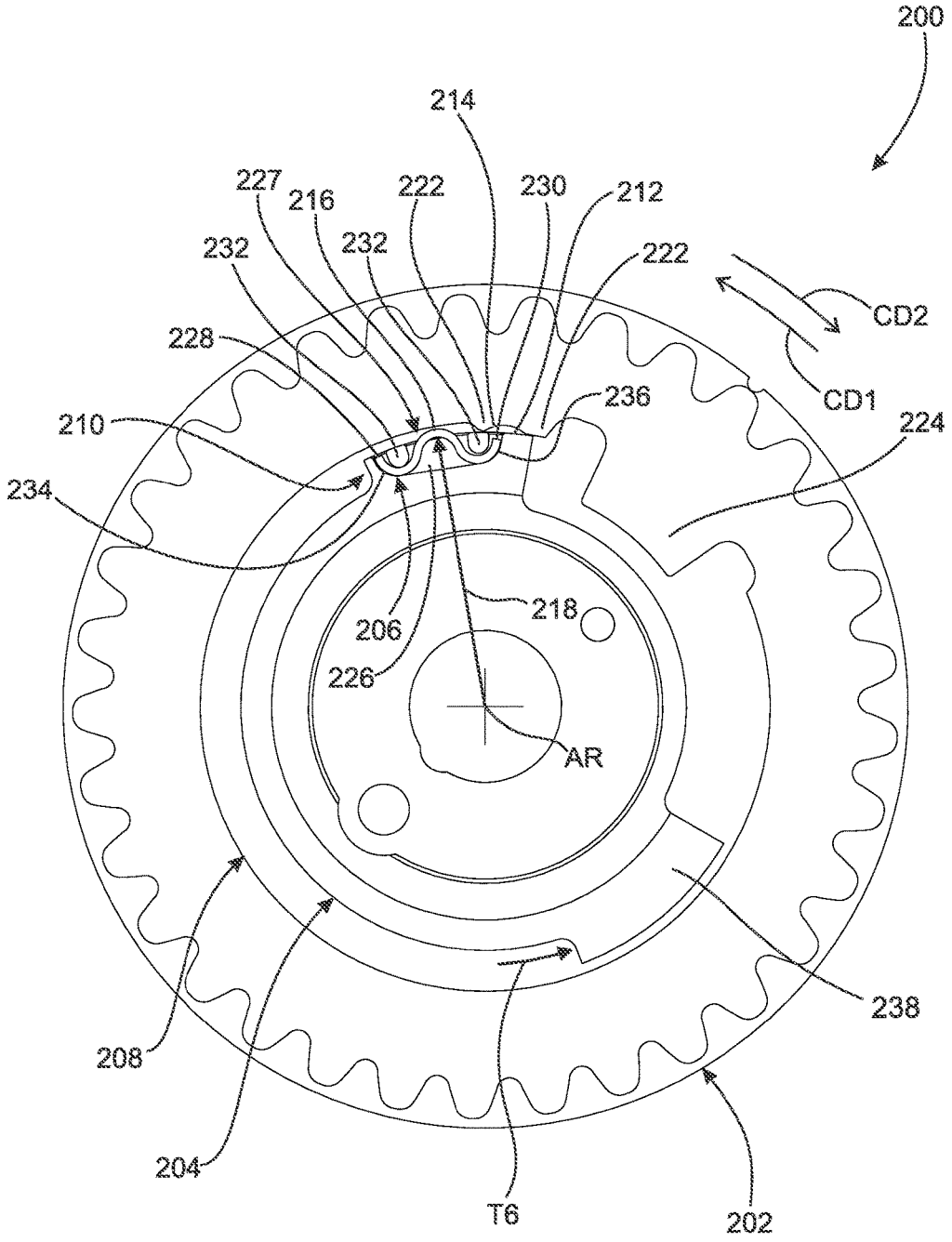
FIG. 5 is a cut-away view of a camshaft phaser with a rotor in a first circumferential position associated with an operating mode for the camshaft phaser.

FIG. 5 is a cut-away view of camshaft phaser 200 with a rotor in a first circumferential position associated with an operating mode for phaser 200.

Figure 6:
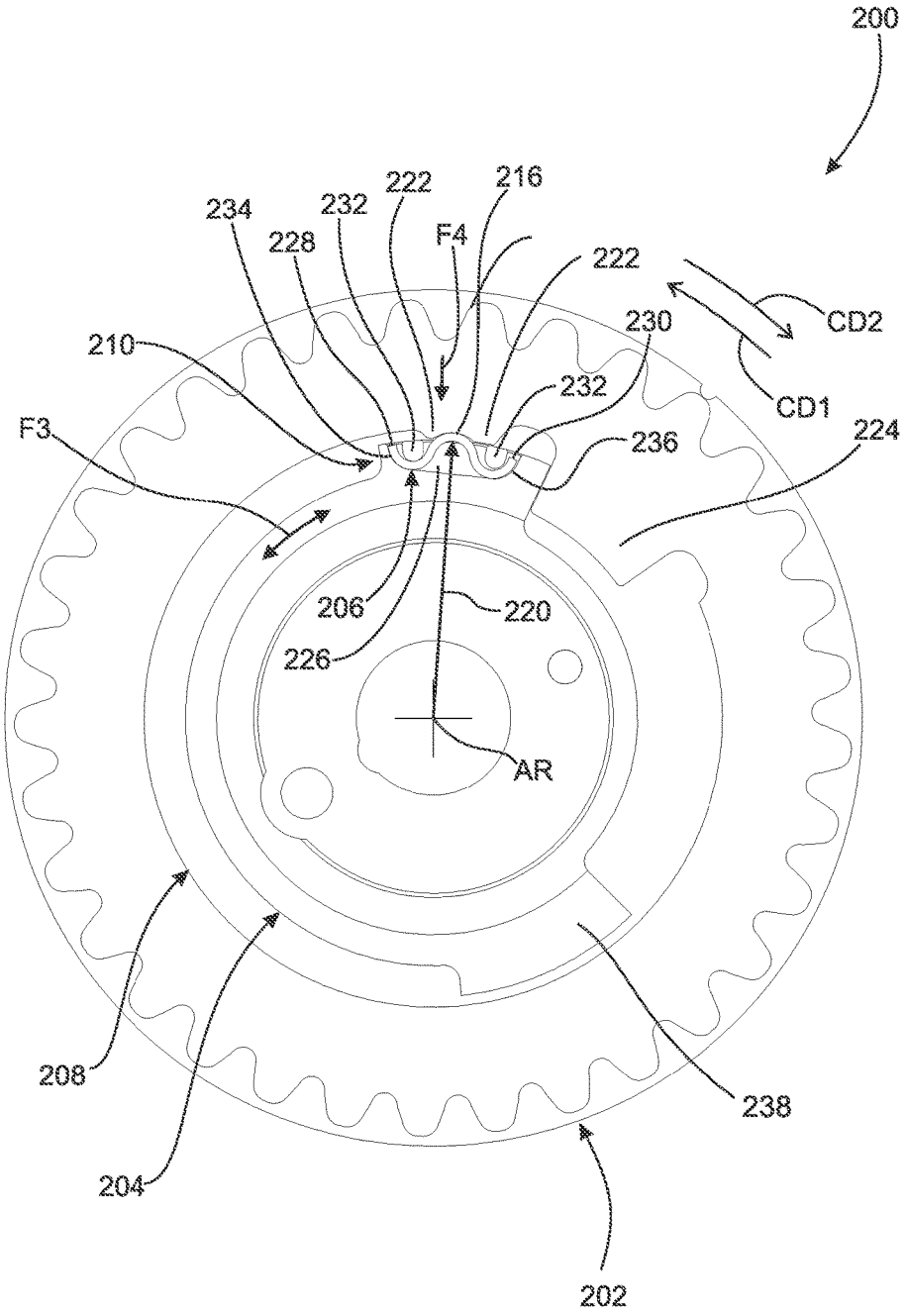
FIG. 6 is a cut-away view of the camshaft phaser of FIG. 5 with the rotor in a second circumferential position associated with a locked mode for the camshaft phaser.

FIG. 6 is a cut-away view of camshaft phaser 200 of FIG. 5 with the rotor in a second circumferential position associated with a locked mode for phaser 200.

Figure 7:
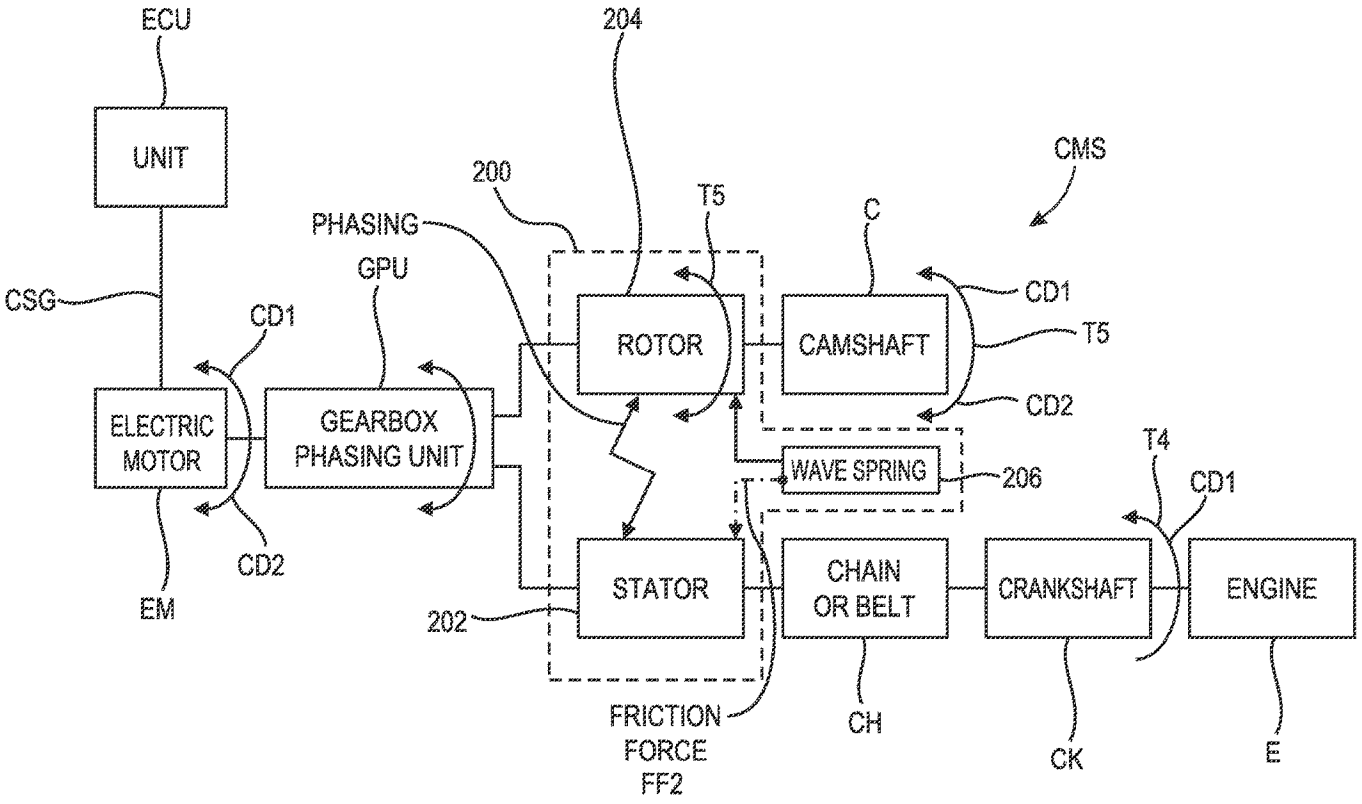
FIG. 7 is a block diagram including the camshaft phaser of FIGS. 5 and 6.

FIG. 7 is a block diagram including camshaft phaser 200 of FIGS. 5 and 6. The following should be viewed in light of FIGS. 5 through 7. Camshaft phaser 200 includes stator 202, rotor 204, axis of rotation AR for stator 202 and rotor 204, and wave spring 206 non-rotatably connected to rotor 204. Stator 202 is arranged to receive rotational torque T4 from engine E, via crankshaft CK and chain or belt CH, and includes radially inwardly facing surface 208. Rotor 204: is arranged to non-rotatably connect to camshaft C; is arranged to be connected to electric motor EM; and includes radially outwardly extending protrusion 210. Protrusion 210 includes radially outer surface 212. Surface 208 includes radially outwardly extending indent 214.

As is known in the art, in the operating mode in which engine E is running and torque T4 is being transmitted to stator 202 in direction CD1: motor EM rotates rotor 204 and camshaft C in direction CD1 and motor EM simultaneously rotates rotor 204, with respect to stator 202, in opposite circumferential directions CD1 and CD2 as needed, using gearbox phasing unit GPU to set a control angle for rotor 204 and control phasing of camshaft C with respect to stator 202.

In the example first circumferential position of rotor 204 with respect to stator 202 shown in FIG. 5, no portion of spring 206 is disposed in indent 214. In the second circumferential position of rotor 204 with respect to stator 202, shown in FIG. 6, portion 216 of spring 206 is disposed in indent 214. As further described below, the engagement of portion 216 with indent 214 maintains rotor 204 in the second circumferential position after engine E is de-energized. It should be understood that the exact circumferential position of rotor 204 in FIG. 5 is an example of the plurality of specific circumferential positions possible during the operating mode when portion 216 is not engaged with indent 214. Stated otherwise, any position of rotor 204 in which spring 206 is not in contact with radially outer surface 212 is considered the first circumferential position.

As discussed above, a problem for a known camshaft phaser is "drift" of a rotor for the phaser immediately or shortly after engine shut-down. For example, camshaft C applies torque T5 to rotor 204 upon shut-down of engine E. Note that torque T5 is shown in opposite circumferential directions CD1 and CD2, since torque T5 may oscillate between directions CD1 and CD2 after shutdown of engine E. Advantageously, the engagement of spring 206 with indent 214 provides a means of providing a known position of rotor 204 upon engine start up.

For example, upon shut-down of engine E, control signal CSG is sent from electronic control unit ECU to motor EM. In response to signal CSG, motor EM rotates rotor 204, in the example of FIGS. 5 and 6, in circumferential direction CD2, until portion 216 engages indent 214. Spring 206 applies frictional force FF2 to stator 204. Force FF2 resists rotation of rotor 204 with force F3 greater than torque T5. Thus forces F3 and FF2 prevent torque T5 from rotating rotor 204, and rotor 204 remains in the known position of FIG. 6 for engine start up.

Upon engine start-up, motor EM rotates, in the example of FIGS. 5 and 6, rotor 204 in direction CD1 with torque T6 to overcome the resistance from force F3. That is, torque T6 is greater than force F3. Thus, rotor 204 disengages from spring 206 for normal operation of phaser 200 (engine E is activated and phaser 200 is controlling camshaft C).

In an example embodiment of the second circumferential position, stator 202 displaces portion 216 radially inwardly. Thus, in the first circumferential position of rotor 204, portion 216 is at radial distance 218 from axis AR and in the second circumferential position of rotor 204, portion, 216 is at radial distance 220, less than distance 218 from axis AR.

In the example of FIGS. 5 and 6, spring 206 does not contact surface 208 once rotor 204 rotates out of the second circumferential position of FIG. 6 into the first circumferential position of FIG. 5 and phaser 200 is in the normal operating mode.

Stator 202 includes radially inwardly extending end stop 224. In the example of FIGS. 5 and 6, protrusion 210 is in contact with stop 224 in the second circumferential position. However, it should be understood that is not necessary for protrusion 204 to be in contact with stop 224 in the second circumferential position.

In the example of FIGS. 5 and 6: rotor 204 includes slot 226, a least a portion of which is in surface 212; spring 206 includes portion 227, located in slot 226, with ends 228 and 230, disposed within slot 226; and portion 216 of spring 206 extends radially outwardly past surface 212. In an example embodiment, stator 202 includes posts 232 engaged with spring 206 and retaining spring 206 in slot 226. In an example embodiment: ends 228 and 230 are in contact with walls 234 and 236, respectively, of slot 226 in the first and second circumferential positions. Force F4, applied by stator 202 on spring 206 in the second circumferential position, causes spring 206 to flex.

In an example embodiment: end stop 224 is the only radially inwardly projecting end stop for stator 202; rotor 204 includes radially outwardly extending protrusion 238; protrusions 210 and 238 are the only radially outwardly extending protrusions for rotor 204; and end stop 224 is circumferentially disposed between protrusions 210 and 238.

Figure 8:
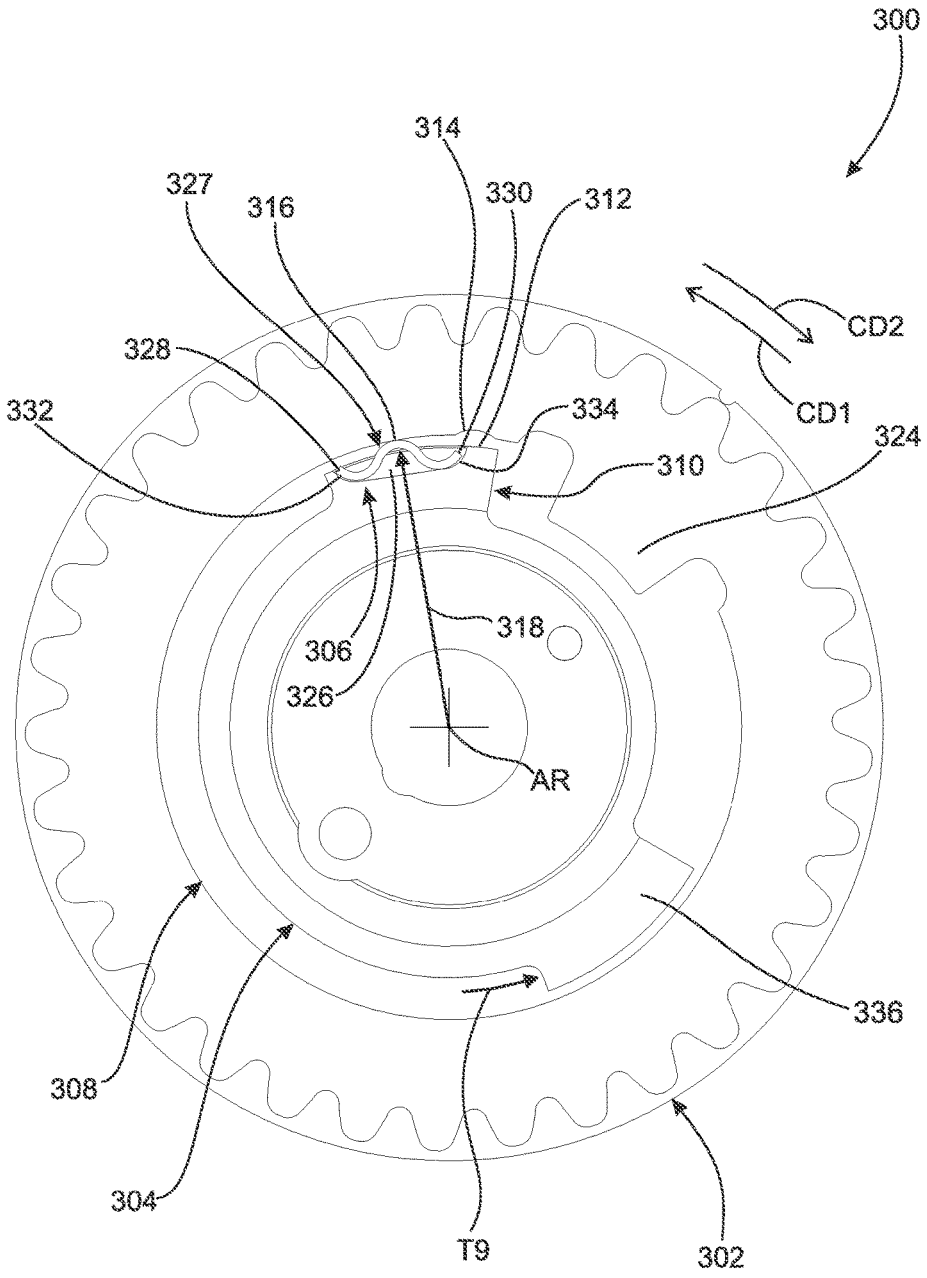
FIG. 8 is cut-away view of a camshaft phaser with a rotor in a first circumferential position associated with an operating mode for the camshaft phaser.

FIG. 8 is a cut-away view of camshaft phaser 300 with a rotor in a first circumferential position associated with an operating mode for phaser 300.

Figure 9:
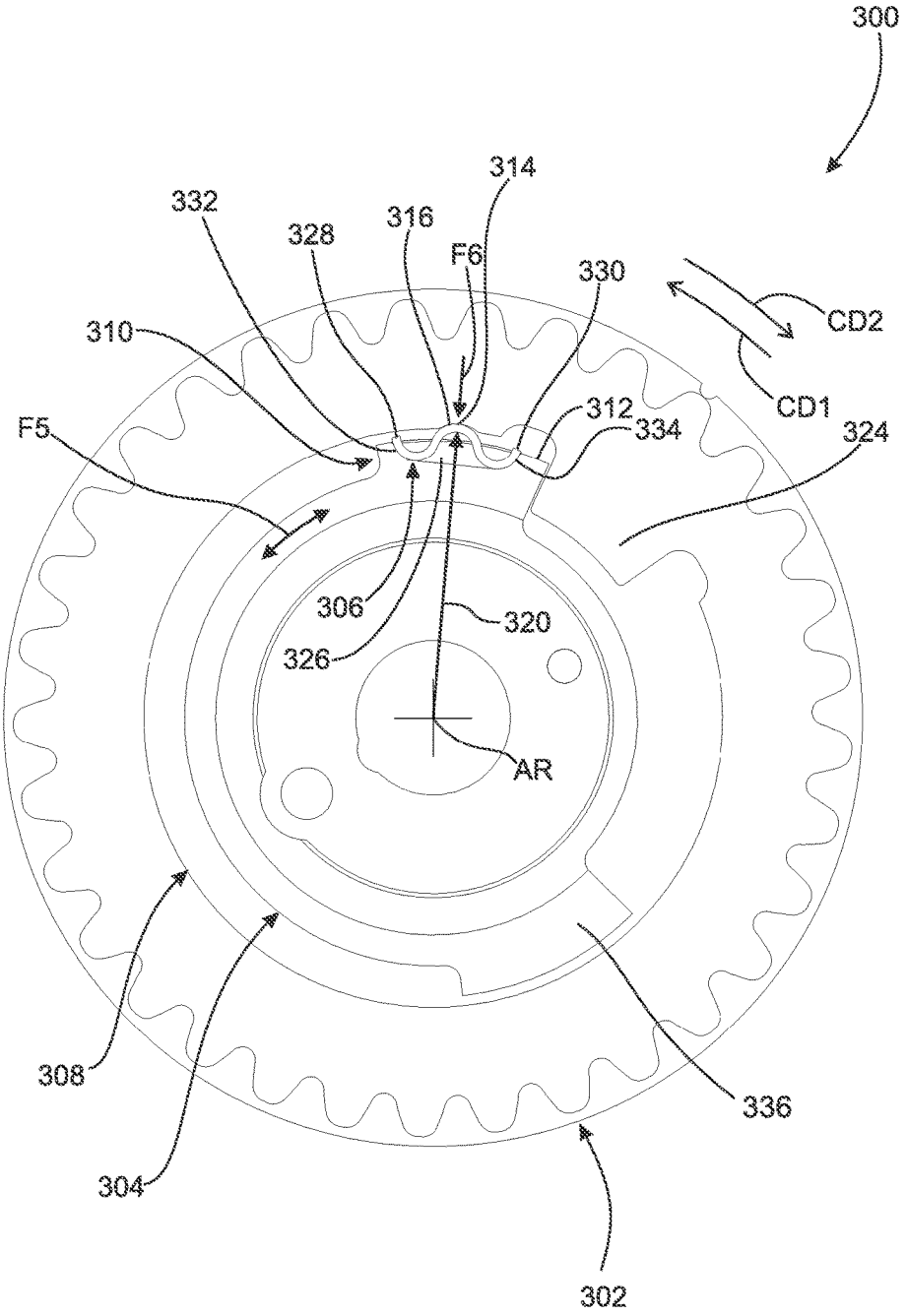
FIG. 9 is a cut-away view of the camshaft phaser of FIG. 8 with the rotor in a second circumferential position associated with a locked mode for the camshaft phaser.

FIG. 9 is a cut-away view of camshaft phaser 300 of FIG. 8 with the rotor in a second circumferential position associated with a locked mode for phaser 300.

Figure 10:
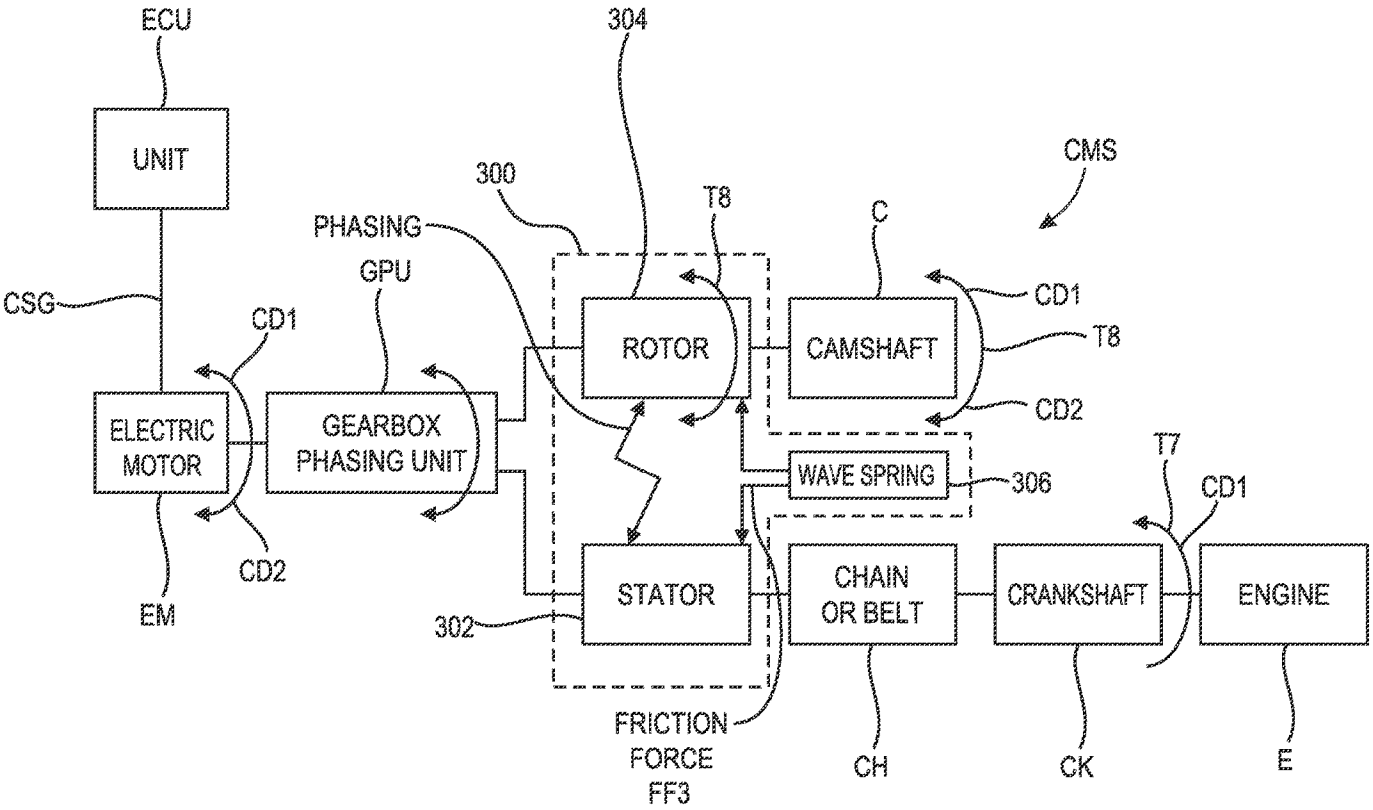
FIG. 10 is a block diagram including the camshaft phaser of FIGS. 8 and 9.

FIG. 10 is a block diagram including camshaft phaser 300 of FIGS. 8 and 9. The following should be viewed in light of FIGS. 8 through 10. Camshaft phaser 300 includes stator 302, rotor 304, axis of rotation AR for stator 302 and rotor 304, and wave spring 306 non-rotatably connected to rotor 304. Stator 302 is arranged to receive rotational torque T7 from engine E, via crankshaft CK and chain or belt CH, and includes radially inwardly facing surface 308. Rotor 304: is arranged to non-rotatably connect to camshaft C; is arranged to be connected to electric motor EM; and includes radially outwardly extending protrusion 310. Protrusion 310 includes radially outer surface 312. Surface 308 includes radially outwardly extending indent 314.

As is known in the art, in the operating mode in which engine E is running and torque T7 is being transmitted to stator 302 in direction CD1: motor EM rotates rotor 304 and camshaft C in direction CD1 and motor EM simultaneously rotates rotor 304, with respect to stator 302, in opposite circumferential directions CD1 and CD2 as needed, using gearbox phasing unit GPU to set a control angle for rotor 304 and control phasing of camshaft C with respect to stator 302.

In the second circumferential position of rotor 304 with respect to stator 302, shown in FIG. 9, portion 316 of spring 306 is disposed in indent 314. As further described below, the engagement of portion 316 with indent 314 maintains rotor 304 in the second circumferential position when engine E is de-energized. It should be understood that the exact circumferential position of rotor 304 in FIG. 8 is an example of the plurality of specific circumferential positions possible during the operating mode when portion 316 is not engaged with indent 314. Stated otherwise, any position of rotor 304 in which spring 306 is not in contact with radially outer surface 312 is considered the first circumferential position.

As discussed above, a problem for a known camshaft phaser is "drift" of a rotor for the phaser at engine shut-down. For example, camshaft C applies torque T8 to rotor 304 upon shut-down of engine E. Note that torque T8 is shown in opposite circumferential directions CD1 and CD2, since the torque may oscillate between directions CD1 and CD2 after shutdown of engine E. Advantageously, the engagement of spring 306 with indent 314 provides a means of providing a known position of rotor 304 upon engine start up.

For example, upon shut-down of engine E, control signal CSG is sent from electronic control unit ECU to motor EM. In response to signal CSG, motor EM rotates rotor 304, in the example of FIGS. 8 and 9, in circumferential direction CD2, until portion 316 engages indent 314. Spring 306 applies frictional force FF3 to rotor 304. Force FF3 resists rotation of rotor 304 with force F5 greater than torque T8. Thus forces F5 and FF3 prevent torque T8 from rotating rotor 304 and rotor 304 remains in the known position of FIG. 9 for engine start up.

Upon engine start-up, motor EM rotates, in the example of FIGS. 8 and 9, rotor 304 in direction CD1 with torque T9 to overcome the resistance from friction force FF3. Thus, rotor 304 disengages from spring 306 for normal operation of phaser 300 (engine E is activated and phaser 100 is controlling camshaft C).

In an example embodiment of the second circumferential position, stator 302 displaces portion 316 radially inwardly. Thus, in the first circumferential position, portion 316 is at radial distance 318 from axis AR and in the second circumferential position portion, 316 is at radial distance 320, greater than distance 318 from axis AR.

In the example of FIGS. 8 and 9, spring 306 contacts surface 308, once rotor 304 rotates out of the second circumferential position and phaser 300 is in the operating mode.

Stator 302 includes radially inwardly extending end stop 324. In the example of FIGS. 8 and 9 protrusion 304 is in contact with stop 324 in the second circumferential position. However, it should be understood that is not necessary for protrusion 304 to be in contact with stop 324 in the second circumferential position.

In the example of FIGS. 8 and 9: rotor 304 includes slot 326, a least a portion of which is in surface 312; spring 306 includes portion 327, located in slot 326, with ends 328 and 330, disposed within slot 326; and portion 316 of spring 306 extends radially outwardly past surface 312. In an example embodiment: ends 328 and 330 are in contact with walls 332 and 334, respectively, of slot 326 in the first and second circumferential positions. Force F6, applied by stator 302 on spring 306 in the second circumferential position, causes spring 306 to flex.

In an example embodiment: end stop 324 is the only radially inwardly projecting end stop for stator 302; rotor 304 includes radially outwardly extending protrusion 336; protrusions 310 and 336 are the only radially outwardly extending protrusions for rotor 304; and end stop 324 is circumferentially disposed between protrusions 310 and 338.

The following should be viewed in light of FIGS. 1 through 4. The following describes a method of using a camshaft phaser with rotor lock. Although the method is presented as a sequence of steps for clarity, no order should be inferred from the sequence unless explicitly stated. A first step non-rotatably connects rotor 104 to camshaft C. A second step connects rotor 104 to electric motor EM. A third step receives, with stator 102, rotational torque T1 in direction CD1 from engine E. A fourth step rotates, with gearbox phasing unit GPU, camshaft C in direction CD1. A fifth step removes torque T1 from stator 102 by shutting engine E off. A sixth step rotates, with electric motor EM, rotor 104 in direction CD2 with respect to stator 102. A seventh step disposes portion 116 of spring 106 in indent 114 in rotor 104. An eighth step receives, on rotor 104 and from camshaft C, rotational torque T2. A ninth step blocks, with engagement of portion 116 with indent 114, rotation of rotor 104 with respect to stator 102. A tenth step keeps portion 116 in indent 114.

An eleventh tenth step receives, with the stator, rotational torque T1 in direction CD1 from engine E. A twelfth step rotates, with electric motor EM, rotor 104 in direction CD1 with respect to stator 102. A thirteenth step disengages portion 116 from indent 114. In an example embodiment, rotating, with electric motor EM, rotor 104 in direction CD1 with respect to stator 102 includes avoiding contact between spring 106 and radially inwardly facing surface 108 of stator 102. In an example embodiment, rotating, with electric motor EM, rotor 104 in direction CD2 with respect to stator 102 in the sixth step includes contacting end stop 124 with protrusion 110.

Disposing portion 116 of spring 106 in indent 114 in rotor 104 includes applying frictional force FF1 to rotor 102 with spring 106. Blocking, with engagement of portion 116 with indent 114, rotation of rotor 104 with respect to stator 102 includes blocking, with frictional force FF1 and force F1 greater than torque T2.

The following should be viewed in light of FIGS. 5 through 7. The following describes a method of using a camshaft phaser with rotor lock. Although the method is presented as a sequence of steps for clarity, no order should be inferred from the sequence unless explicitly stated. A first step non-rotatably connects rotor 204 to camshaft C. A second step connects rotor 204 to electric motor EM. A third step receives, with stator 202, rotational torque T4 in direction CD1 from engine E. A fourth step rotates, with gearbox phasing unit GPU, camshaft C in direction CD1. A fifth step removes torque T4 from stator 202 by shutting engine E off. A sixth step rotates, with electric motor EM, rotor 204 in direction CD2 with respect to stator 102. A seventh step disposes portion 216 of spring 206 in indent 214 in stator 202. An eighth step receives, on rotor 204 and from camshaft C, rotational torque T5. A ninth step blocks, with engagement of portion 216 with indent 114, rotation of rotor 204 with respect to stator 202. A tenth step keeps portion 216 in indent 214.

An eleventh tenth step receives, with the stator, rotational torque T4 in direction CD1 from engine E. A twelfth step rotates, with electric motor EM, rotor 204 in direction CD1 with respect to stator 202. A thirteenth step disengages portion 216 from indent 214. In an example embodiment, rotating, with electric motor EM, rotor 204 in direction CD1 with respect to stator 202 includes avoiding contact between spring 206 and radially inwardly facing surface 208 of stator 202. In an example embodiment, rotating, with electric motor EM, rotor 204 in direction CD2 with respect to stator 202 in the sixth step includes contacting end stop 224 with protrusion 210.

Disposing portion 216 of spring 206 in indent 214 in stator 202 includes applying frictional force FF2 to rotor 202 with spring 206. Blocking, with engagement of portion 216 with indent 214, rotation of rotor 204 with respect to stator 202 includes blocking, with frictional force FF2 and force F3 greater than torque T5.

The following should be viewed in light of FIGS. 8 through 10. The following describes a method of using a camshaft phaser with rotor lock. Although the method is presented as a sequence of steps for clarity, no order should be inferred from the sequence unless explicitly stated. A first step non-rotatably connects rotor 304 to camshaft C. A second step connects rotor 304 to electric motor EM. A third step receives, with stator 302, rotational torque T7 in direction CD1 from engine E. A fourth step rotates, with gearbox phasing unit GPU, camshaft C in direction CD1. A fifth step removes torque T7 from stator 302 by shutting engine E off. A sixth step rotates, with electric motor EM, rotor 304 in direction CD2 with respect to stator 302. A seventh step disposes portion 316 of spring 306 in indent 314 in stator 302. An eighth step receives, on rotor 304 and from camshaft C, rotational torque T8. A ninth step blocks, with engagement of portion 316 with indent 314, rotation of rotor 304 with respect to stator 302. A tenth step keeps portion 316 in indent 314.

An eleventh tenth step receives, with the stator, rotational torque T7 in direction CD1 from engine E. A twelfth step rotates, with electric motor EM, rotor 304 in direction CD1 with respect to stator 302. A thirteenth step disengages portion 316 from indent 314. In an example embodiment, rotating, with electric motor EM, rotor 304 in direction CD2 with respect to stator 302 in the sixth step includes contacting end stop 324 with protrusion 310.

Disposing portion 316 of spring 306 in indent 314 in stator 302 includes applying frictional force FF3 to rotor 302 with spring 306. Blocking, with engagement of portion 316 with indent 314, rotation of rotor 304 with respect to stator 302 includes blocking, with frictional force FF3 and force F5 greater than torque T8.

Camshaft phaser 100 is not limited to the exact location of spring 106 shown. For example, in FIGS. 2 and 3, spring 106 is located such that in the locked position of FIG. 3, rotor 104 is locked in a full retard position. However, spring 106 can be located on the other side of end stop 124 (between end stop 124 and protrusion 138) and indent 114 can be located on protrusion 138 so that the locked position of rotor 104 is in the full advance position with protrusion 138 in contact with end stop 124. As well, spring 106 can be located further away from end stop 124 in direction CD1 so that the locked position for rotor 104 is between the full retard and full advance position. Also, directions CD1 and CD2 can be reversed and the locations of spring 106 and indent 114 moved as needed. For example, with directions CD1 and CD2 reversed, the full retard position of FIG. 3 is a full advance position.

Camshaft phaser 200 is not limited to the exact location of spring 206 shown. For example, in FIGS. 5 and 6, spring 206 is located such that in the locked position of FIG. 6, rotor 204 is locked in a full retard position. However, spring 206 can be located on protrusion 238 and indent 214 can be located so that the locked position of rotor 204 is in the full advance position with protrusion 238 in contact with end stop 224. As well, indent 214 can be located further away from end stop 224 in direction CD1 so that the locked position for rotor 204 is between the full retard and full advance position. Also, directions CD1 and CD2 can be reversed and the locations of spring 206 and indent 214 moved as needed. For example, with directions CD1 and CD2 reversed, the full retard position in FIG. 6 is a full advance position.

The discussion for camshaft phaser 200 with respect to positions for spring 206 and indent 214 and the reversal of directions CD1 and CD2 is applicable to camshaft phaser 300.

Advantageously, phasers 100, 200, and 300 each address the problem noted above of "drift" of a rotor in a camshaft phaser at engine shut-down. Specifically, upon receipt of signal CSG indicating that engine E is shutting down, motor EM rotates rotors 104, 204 and 304 into the locked modes shown in FIGS. 3, 6, and 9, respectively. In the locked mode, portions 116, 216, and 316 are located in indents 114, 214, and 314, respectively. Springs 106, 206, and 306 are designed to generate friction forces FF1, FF2, FF3, respectively, resulting in forces F1, F3, and F5, respectively, blocking torque T2, T5, and T8, respectively, from camshaft C from rotating rotors 104, 204 and 304 out of the respective locked modes (respective second circumferential positions).

Springs 106, 206, and 306 also are designed such that motor EM is able to easily rotate rotors 104, 204 and 304 out of the respective locked modes (respective second circumferential positions). Advantageously, in phasers 100 and 200, springs 106 and 206, respectively, do not contact rotor 104 or stator 202, respectively, in the operating mode. For example this clearance is enabled by: protrusions 122 which extend radially inward to define indent 114 and enable a travel path for spring 106 free of contact with stator 108; and protrusions 222 which extend radially outward to define indent 214 and enable a travel path for spring 206 free of contact with rotor 204. Thus, spring 106 and 206 do not cause a drag on motor EM and springs 106 and 206 are relaxed in the operating mode, prolonging the service life of springs 106 and 206.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
R radius
12 object
13 object
14 object
15A surface
15B surface
15C edge
16A surface
16B edge
17A radius
17B radius
18 surface
19 circumference
20 radius
C camshaft
CD1 circumferential direction
CD2 circumferential direction
CH chain or belt
CK crankshaft
CSG control signal
E engine
ECU electronic control unit
EM electric motor
F1 force from FF1
F2 force on spring 106
F3 force from FF2
F4 force on spring 206
F5 force from FF3
F6 force on spring 306
FF1 frictional force
FF2 frictional force
FF3 frictional force
GPU gearbox phasing unit
T1 torque from engine E
T2 torque from camshaft C
T3 torque from motor EM
T4 torque from engine E
T5 torque from camshaft C
T6 torque from motor EM
T7 torque from engine E
T8 torque from camshaft C
T9 torque from motor EM
100 camshaft phaser
102 stator
104 rotor
106 wave spring
108 radially inwardly facing surface of stator 102
110 protrusion for rotor 104
112 radially outer surface of protrusion 110
114 indent in surface 112
116 portion of spring 106
118 radial distance
120 radial distance
122 protrusion on surface 112
124 end stop of stator 102
126 slot in stator 102
127 portion of spring 106
128 end of spring 106
130 end of spring 106
132 post
134 wall of slot 126
136 wall of slot 126
138 protrusion for rotor 104
200 camshaft phaser
202 stator
204 rotor
206 wave spring
208 radially inwardly facing surface of stator 202
210 protrusion for rotor 204
212 radially outer surface of protrusion 210
214 indent in surface 112
116 portion of spring 106
218 radial distance
220 radial distance
222 protrusion on surface 208
224 end stop of stator 202
226 slot in rotor 204
227 portion of spring 206
228 end of spring 206
230 end of spring 206
232 post
234 wall of slot 226
236 wall of slot 226
238 protrusion for rotor 204
300 camshaft phaser
302 stator
304 rotor

306 wave spring
308 radially inwardly facing surface of stator 302
310 protrusion for rotor 304
312 radially outer surface of protrusion 310
314 indent in surface 312
316 portion of spring 306
318 radial distance
320 radial distance
324 end stop of stator 302
326 slot in rotor 304
327 portion of spring 306
328 end of spring 306
330 end of spring 306
332 wall of slot 326
336 wall of slot 326
338 protrusion for rotor 304

The invention claimed is:

1. A camshaft phaser, comprising:
a stator arranged to receive rotational torque from an engine and including a radially inwardly facing surface;
a rotor:
arranged to non-rotatably connect to a camshaft;
arranged to be connected to an electric motor; and,
including a first radially outwardly extending protrusion, the first radially outwardly extending protrusion including a radially outer surface;
an axis of rotation for the stator and rotor; and,
a spring, wherein:
the electric motor is arranged to rotate the rotor with respect to the stator; and,
the radially outer surface includes an indent, the spring is non-rotatably connected to the stator, in a first circumferential position of the rotor with respect to the stator, no portion of the spring is disposed in the indent, and in a second circumferential position of the rotor with respect to the stator, a first portion of the spring is disposed in the indent; or,
the radially inwardly facing surface includes an indent, the spring is non-rotatably connected to the rotor, in a first circumferential position of the rotor with respect to the stator, no portion of the spring is disposed in the indent, and in a second circumferential position of the rotor with respect to the stator, a first portion of the spring is disposed in the indent.

2. The camshaft phaser of claim 1, wherein:
the radially outer surface includes the indent and the spring is non-rotatably connected to the stator; and,
in the second circumferential position of the rotor:
the spring applies a frictional force to the rotor;
the frictional force blocks rotation of the rotor with respect to the stator with a first force; and,
a first torque received by the rotor from the camshaft is less than the first force.

3. The camshaft phaser of claim 2, wherein to transition out of the second circumferential position of the rotor:
the rotor is arranged to receive a second torque, greater than the first force, from the electric motor; and,
the rotor rotates in a circumferential direction to displace the first portion of the spring from the indent.

4. The camshaft phaser of claim 2, wherein:
the stator includes a slot, a least a portion of which is in the radially inwardly facing surface;
the spring includes first and second ends disposed within the slot; and,
the first portion of the spring extends radially inwardly past the radially inwardly facing surface.

5. The camshaft phaser of claim 2, wherein:
in the first circumferential position of the rotor, the first portion of the spring is at a first radial distance from the axis of rotation; and,
in the second circumferential position of the rotor, the first portion of the spring is at a second radial distance, greater than the first radial distance, from the axis of rotation.

6. The camshaft phaser of claim 1, wherein:
the radially inwardly facing surface includes the indent and the spring is non-rotatably connected to the rotor; and,
in the second circumferential position of the rotor:
the spring applies a frictional force to the stator;
the frictional force blocks rotation of the rotor with respect to the stator with a first force; and,
a first torque received by the rotor from the camshaft is less than the first force.

7. The camshaft phaser of claim 6, wherein to transition out of the second circumferential position of the rotor:
the rotor is arranged to receive a second torque, greater than the first force, from the electric motor; and,
the rotor rotates in a circumferential direction to displace the first portion of the spring from the indent.

8. The camshaft phaser of claim 6, wherein:
the rotor includes a slot in the radially outer surface;
the spring includes first and second ends disposed within the slot; and,
the first portion of the spring extends radially outwardly past the radially outer surface.

9. The camshaft phaser of claim 6, wherein:
in the first circumferential position of the rotor, the first portion of the spring is at a first radial distance from the axis of rotation; and,
in the second circumferential position of the rotor, the first portion of the spring is at a second radial distance, less than the first radial distance, from the axis of rotation.

10. The camshaft phaser of claim 1, wherein:
the stator includes a radially inwardly projecting end stop;
the radially inwardly projecting end stop is the only radially inwardly projecting end stop for the stator;
the rotor includes a second radially outwardly extending protrusion;
the first and second radially outwardly extending protrusions are the only radially outwardly extending protrusions for the rotor; and,
the radially inwardly projecting end stop is circumferentially disposed between the first and second radially outwardly extending protrusions.

11. A method of using the camshaft phaser of claim 1, comprising:
non-rotatably connecting the rotor to the camshaft;
connecting the rotor to the electric motor;
receiving, with the stator, first rotational torque from the engine;
rotating the camshaft with a gearbox phasing unit;
removing, from the stator, the first rotational torque by shutting off the engine;
rotating, in response to removing the first rotational torque and with the electric motor, the rotor, with respect to the stator;
disposing the first portion of the spring in the indent;
receiving, on the rotor and from the camshaft, a second rotational torque; and, blocking, with engagement of the first portion with the indent, rotation of the rotor with respect to the stator.

12. The method of claim 11, further comprising:

receiving, with the stator, a third rotational torque from the engine;

rotating, in response to receiving the third rotational torque and with the electric motor, the rotor, with respect to the stator; and, disengaging the first portion from the indent.

13. The method of claim 12, wherein:

the spring is non-rotatably connected to the stator; and, rotating, in response to receiving the third rotational torque and with the electric motor, the rotor, with respect to the stator includes avoiding contact between the spring and the rotor; or, wherein:

the spring is non-rotatably connected to the rotor; and, rotating, in response to receiving the third rotational torque and with the electric motor, the rotor, with respect to the stator, includes avoiding contact between the spring and the stator; or, wherein rotating, in response to removing the first rotational torque and with the electric motor, the rotor, with respect to the stator includes contacting the first radially outwardly extending protrusion with an end stop for the stator.

14. The method of claim 11, wherein disposing the first portion of the spring in the indent includes applying a frictional force, with the spring to the rotor or the stator; or, blocking, with the engagement of the first portion with the indent, rotation of the rotor with respect to the stator includes blocking, with a frictional force between the spring and the rotor.

15. A camshaft phaser, comprising:

a stator arranged to receive rotational torque from an engine and including:

a radially inwardly facing surface; and, a slot in the radially inwardly facing surface;

a rotor:

arranged to non-rotatably connect to a camshaft;

arranged to be connected to an electric motor; and, including a first radially outwardly extending protrusion, the first radially outwardly extending protrusion including a radially outer surface with an indent;

an axis of rotation for the stator and rotor; and, a spring non-rotatably connected to the stator and including a first portion disposed in the slot, wherein:

the electric motor is arranged to rotate the rotor with respect to the stator;

in a first circumferential position of the rotor with respect to the stator:

no portion of the spring is disposed in the indent; and, a second portion of the spring extends radially inwardly past the radially inwardly facing surface; and, in a second circumferential position of the rotor with respect to the stator, the second portion of the spring is disposed in the indent.

16. A method of using the camshaft phaser of claim 15, comprising:

non-rotatably connecting the rotor to the camshaft;

connecting the rotor to the electric motor;

receiving, with the stator, first rotational torque from the engine;

rotating the camshaft with a gearbox phasing unit;

removing, from the stator, the first rotational torque by shutting off the engine;

rotating, in response to removing the first rotational torque and with the electric motor, the rotor, with respect to the stator;

disposing the second portion of the spring in the indent;

receiving, on the rotor and from the camshaft, a second rotational torque; and, blocking, with engagement of the second portion with the indent, rotation of the rotor with respect to the stator.

17. The method of claim 16, further comprising:

receiving, with the stator, third rotational torque from the engine;

rotating, in response to receiving the third rotational torque and with the electric motor, the rotor, with respect to the stator; and, disengaging the second portion from the indent.

18. A camshaft phaser, comprising:

a stator arranged to receive rotational torque from an engine and including a radially inwardly facing surface with an indent;

a rotor:

arranged to non-rotatably connect to a camshaft;

arranged to be connected to an electric motor; and, including a first radially outwardly extending protrusion, the first radially outwardly extending protrusion including a radially outer surface and a slot in the radially outer surface;

an axis of rotation for the stator and rotor; and, a spring non-rotatably connected to the rotor and including a first portion disposed in the slot, wherein:

the electric motor is arranged to rotate the rotor with respect to the stator;

in a first circumferential position of the rotor with respect to the stator:

no portion of the spring is disposed in the indent; and, a second portion of the spring extends radially outwardly past the radially outer surface; and, in a second circumferential position of the rotor with respect to the stator, the second portion of the spring is disposed in the indent.

19. A method of using the camshaft phaser of claim 18, comprising:

non-rotatably connecting the rotor to the camshaft;

connecting the rotor to the electric motor;

receiving, with the stator, first rotational torque from the engine;

rotating the camshaft with a gearbox phasing unit;

removing, from the stator, the first rotational torque by shutting off the engine;

rotating, in response to removing the first rotational torque and with the electric motor, the rotor, with respect to the stator;

disposing the second portion of the spring in the indent;

receiving, on the rotor and from the camshaft, second rotational torque; and, blocking, with engagement of the second portion with the indent, rotation of the rotor with respect to the stator.

20. The method of claim 19, further comprising:

receiving, with the stator, third rotational torque from the engine;

rotating, in response to receiving the third rotational torque and with the electric motor, the rotor, with respect to the stator; and, disengaging the second portion from the indent.

* * * * *